US011305295B2

(12) United States Patent
Dascalescu et al.

(10) Patent No.: US 11,305,295 B2
(45) Date of Patent: Apr. 19, 2022

(54) METHOD AND DEVICE FOR THE ELECTROSTATIC SEPARATION OF GRANULAR MATERIALS

(71) Applicants: Université de Poitiers, Poitiers (FR); Centre National de la Recherche Scientifique, Paris (FR)

(72) Inventors: Lucien Dascalescu, Angoulême (FR); Thami Zeghloul, Angoulême (FR); Karim Medles, Angoulême (FR)

(73) Assignees: Université de Poitiers, Poitiers (FR); Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 16/976,968

(22) PCT Filed: Mar. 7, 2019

(86) PCT No.: PCT/FR2019/050518
§ 371 (c)(1),
(2) Date: Nov. 26, 2020

(87) PCT Pub. No.: WO2019/171011
PCT Pub. Date: Sep. 12, 2019

(65) Prior Publication Data

US 2021/0078016 A1 Mar. 18, 2021

(30) Foreign Application Priority Data

Mar. 7, 2018 (FR) ..... 1851983

(51) Int. Cl.
*B03C 7/06* (2006.01)
*B03C 7/12* (2006.01)
*B03C 7/00* (2006.01)

(52) U.S. Cl.
CPC ..... *B03C 7/12* (2013.01); *B03C 7/006* (2013.01); *B03C 7/06* (2013.01)

(58) Field of Classification Search
CPC ..... B03C 7/12; B03C 7/006; B03C 7/06
See application file for complete search history.

(56) References Cited

U.S. PATENT DOCUMENTS 5,251,762 A 10/1993 Taylor et al.
5,687,852 A * 11/1997 Raschka ..... B29B 17/02 209/127.4

(Continued)

FOREIGN PATENT DOCUMENTS

DE 1154052 B 9/1963
WO 2019171011 A1 9/2019

OTHER PUBLICATIONS

Foreign Communication from a Related Counterpart Application, International Search Report and Written Opinion dated Jun. 4, 2019, International Application No. PCT/FR2019/050518 filed on Mar. 7, 2019.

*Primary Examiner* — Patrick H Mackey

(57) ABSTRACT

The present invention relates to a method and a device for the electrostatic separation of granular mixtures of millimetric or sub-millimetric size, which are composed of non-conductive particles, non-conductive and conductive particles and conductive particles, simultaneously using the electric field E, aerodynamic force and gravity. Said forces are exerted on the particles which are previously charged in an intense electric field E generated by a DC voltage applied to two coaxial cylinders, that constitute electrodes. A mechanical cleaning system detaches the particles from the surface of the electrodes, and facilitates the recovery thereof in a collection system, under the action of cyclone vacuums, (Continued)

in such a way that the cleaning of the electrodes and the collection of the separated particles is continuously performed.

17 Claims, 9 Drawing Sheets

(56) References Cited

U.S. PATENT DOCUMENTS

| | | | | |
|---|---|---|---|---|
| 6,064,022 | A | 5/2000 | Jackson et al. | |
| 6,498,313 | B1 * | 12/2002 | Stencel | B03C 7/12 209/129 |
| 6,761,752 | B2 * | 7/2004 | Fissan | B03C 3/80 95/74 |
| 7,311,824 | B2 * | 12/2007 | Yoshida | B03C 3/15 210/195.1 |
| 7,931,734 | B2 * | 4/2011 | Moosmuller | B03C 5/00 95/31 |

* cited by examiner

METHOD AND DEVICE FOR THE ELECTROSTATIC SEPARATION OF GRANULAR MATERIALS

CROSS-REFERENCE TO RELATED APPLICATIONS

The present application is a filing under 35 U.S.C. 371 as the National Stage of International Application No. PCT/FR2019/050518, filed Mar. 7, 2019, entitled "METHOD AND DEVICE FOR THE ELECTROSTATIC SEPARATION OF GRANULAR MATERIALS," which claims priority to French Application No. 1851983 filed with the Intellectual Property Office of France on Mar. 7, 2018, both of which are incorporated herein by reference in their entirety for all purposes.

TECHNICAL FIELD

The present invention generally relates to a method for sorting mixtures of granular materials with different electric features (several non-conductive, or several conductive and non-conductive, or even several conductive) using the electric field forces, the aerodynamic forces and gravity. The present invention also relates to a device for implementing such a method.

The method according to the invention is particularly applicable to the separation of granular materials of millimetric and sub-millimetric size (typically particles with an equivalent diameter ranging between 50 μm and 2 mm), in the recycling, mining, pharmaceutical and agri-foodstuffs industries.

PRIOR ART

The techniques of electrostatic separation of mixtures of granular materials with average sizes of more than 1 mm have experienced significant developments over the last two decades and are widely used in industry.

However, at the current time, the separation of finer particles proves to be more difficult to implement, due to the disruptions caused by the aerodynamic forces, the effects of which on the micronized particles (of less than 500 μm) exceed those caused by the electric forces.

Drum electrostatic separators are the solution of choice for treating mixtures of conductive and non-conductive granular materials of millimetric size. They also can be used to separate granular mixtures of millimetric size of several non-conductive materials, previously charged by the triboelectric effect[1], or with several conductive materials, based on the mass density differences between the constituent elements[2]. These separators are also used to separate sub-millimetric mixtures, in particular for treating minerals. However, the flow rates of materials to be treated are low, with the particles having to be dispersed in order to form a single layer on the surface of the drum.

Furthermore, it is known for a person skilled in the art to use free-fall triboelectrostatic separators for sorting larger (typically from 1 to 8 mm) mixtures of non-conductive granular materials. These separators comprise a device that uses the triboelectric effect for charging the granular materials, before allowing them to fall through an intense electric field zone, which is created between two vertical electrodes, one of which is connected to a high-voltage generator and the other one of which is connected to an opposite polarity high-voltage generator or to ground. These separators are not able to treat particles of sub-millimetric size, since the aerodynamic forces and/or adhesion to the electrodes would be too high and would significantly limit the action of the electric field.

In other industrial triboelectrostatic separators known to a person skilled in the art, the particles that are charged either by the triboelectric effect or by corona discharge are deposited as a single layer onto the surface of a metal belt conveyor connected to ground. These particles are sorted in the electric field created between this metal belt and a cylindrical electrode, connected to a high-voltage power supply and located above the conveyor. This type of separator is also used to sort granular mixtures of sub-millimetric size (typically from 0.25 to 1 mm), but only under laboratory conditions since the sorting productivity of a separator of this type is limited by the requirement to deposit the particles as a single layer onto the surface of the strip electrode.

Finally, specific solutions have recently been developed for treating certain granular mixtures of non-conductive materials of sub-millimetric size.

Thus, in a triboelectrostatic separator that can be used in the agro-foodstuffs industry[3], [4], the particles are charged by friction while passing through a metal tube under the action of compressed air, before passing, still in a strictly controlled air flow, into an electric field created between two opposite polarity vertical electrodes. The particles collected on the two electrodes are drawn into cyclone type collectors. Such a separator requires periodic cleaning of the electrodes, which means that it cannot be used in a continuous operating state, in an industrial context.

In other separator models, defined as "tribo-aero-electrostatic"[5], [6] separators, non-conductive particles are charged in a fluidized bed, in the presence of an electric field produced between two electrodes-rotating discs[7], [8], between two rotating cylindrical electrodes[9], or between two electrodes-metal plates[10], executing back-and-forth movements in the vertical direction, whilst being connected to two opposite polarity power supplies. The particles adhere to the opposite polarity electrodes, which discharge them toward the collectors. These installations have been used under laboratory conditions, in an intermittent state, stipulated by the requirement to recover the particles that have remained unseparated in the fluidized bed. The perspectives for the industrial use of these installations are also limited by the difficulty in providing a seal for the fluidization chamber.

DESCRIPTION OF THE INVENTION

In order to overcome the aforementioned faults and disadvantages, the applicant has developed a method and a device for electrostatic separation that simultaneously uses electric field, aerodynamic and gravity forces that are exerted on particles charged in an intense electric field generated by a direct voltage of several thousand volts (typically greater than 5 kV and less than 120 kV) applied to two fixed or rotating coaxial, vertical cylinders. The granular mixture to be separated, composed of particles originating from several non-conductive materials, or from several conductive and non-conductive materials or even from several conductive materials, must be previously charged in charging devices (by corona discharge, by electrostatic induction or by the triboelectric effect). The charged particles are subsequently continuously transferred by a controlled flow rate descending air flow and by the force of gravity in the electric field created between the two coaxial cylindrical electrodes. When attracted by the opposite polarity electrodes, the particles adhere to the surface thereof. A mechanical cleaning system (brushes or wipers), which is fixed if the cylinders rotate, or otherwise is movable, detaches the particles from the surface of the electrodes and facilitates the suction thereof into cyclone collectors. Thus, by virtue of the device and method for electrostatic separation according to the invention, the electrodes can be continuously cleaned and the products can be continuously produced, in a sealed installation, allowing treatment of granular mixtures of millimetric or sub-millimetric size. More specifically, the aim of the present invention is a method for the electrostatic separation of a granular material comprising particles (which can be materials with different natures) having an equivalent diameter ranging between 50 μm and 2 mm, said method comprising the following steps:

A. introducing said granular material into a charging device at a constant flow rate allowing said particles to be charged as a function of their nature, then charging said particles;

B. generating an electric field E between two coaxial cylindrical electrodes with a vertical axis OZ disposed in a separation chamber, the intensity of E varying between 1 kV/cm and 10 kV/cm;

the two cylindrical electrodes being divided into an internal cylindrical electrode with an external diameter $d_{ie}$ and an external cylindrical electrode with an internal diameter $d_{ei}$;

said cylindrical electrodes being connected to a high direct voltage generator (i.e. typically greater than 5 kV and less than 120 kV) with positive or negative polarity, with one of said electrodes being connected to the positive terminal of said generator and the other one of said electrodes being connected to its negative terminal or to ground;

so as to create an electric field zone in the form of a cylindrical layer with a thickness e (typically of the order of 40 mm to 160 mm) that complies with the formula (1):

$$e=(d_{ei}-d_{ie})/2; \quad (1)$$

C. generating, by suction, in said electric field zone, a descending vertical air flow, preferably with a controlled flow rate, and perpendicular to the direction of the electric field E and for which the effect, combined with the effect of gravity, allows said particles, once charged, to be continuously transferred through said electric field zone;

D. moving said charged particles when they are located in said electric field zone to the opposite polarity electrodes in order to adhere thereto;

E. continuously detaching, using mechanical means (for example, brushes or flexible wipers) for cleaning the surface of the electrodes, said particles adhering to the surface of the electrodes, said mechanical cleaning means being free to rotate about the vertical central axis OZ of the electrodes and said electrodes being fixed, or vice versa (in other words, the electrodes are free to rotate about their axis OZ, whereas the mechanical cleaning means are fixed);

F. continuously discharging said detached particles under the combined action of gravity and of said vertical air flow; then G. recovering said particles.

Alternatively, in the step B of generating the electric field E, the cylindrical electrodes can be connected to high direct voltage generators (i.e. typically greater than 5 kV and less than 120 kV) with positive and negative polarities, with one of the electrodes being connected to one of the polarities of said generators, whereas the other one of the electrodes is connected to the other polarity or to ground.

According to a first embodiment of the method according to the invention (illustrated in FIG. 1), the granular material to be separated may only comprise electrically non-conductive particles. In this case, the particles can be charged by the triboelectric effect in a triboelectric charger communicating with the separation chamber via a cone dispenser.

According to a second embodiment of the method according to the invention (illustrated in FIG. 2), the granular material to be separated can comprise a mixture of electrically non-conductive particles and of conductive particles. In this case, the particles can be charged in a corona effect charger located upstream of said electrodes. The corona effect occurs in the vicinity of electrodes with a low curvature radius (points), subject to the high direct voltage generated by the voltage generator, once the electric field E on the surface thereof, called electrodes, becomes large enough (approximately 30 kV/cm), so that the air ionizes and forms around a light corona.

According to a third embodiment of the method according to the invention (illustrated in FIG. 3), the granular material to be separated can comprise a mixture of electrically conductive particles. In this case, the particles can be charged by electrostatic induction created by the electric field E generated between the cylindrical electrodes. The difference between the superficial electric resistance of the materials results in different electric charges for the particles, which are more or less attracted by the cylindrical electrode, thus resulting in their separation. The trajectories of the particles are also affected by the different mass densities.

Advantageously, the particles to be separated can have a diameter ranging between 0.125 mm and 2 mm.

Advantageously, the intensity of the intense electric field E can range between 4 kV/cm and 5 kV/cm.

Advantageously, once the particles are charged on completion of step A of the method according to the invention, they are introduced into the electric field zone in the form of a cylindrical layer with a thickness that ranges between 1 mm and 5 mm, according to the size of the particles forming the mixture to be treated.

Advantageously, the step F) of recovering particles to be separated can be performed in a collection system, with said particles being recovered in intermediate compartments of the collection system, said intermediate compartments being cylindrical, coaxial with the electrodes and each being connected to a cyclone vacuum.

Advantageously, the method according to the invention can further comprise a step of transferring particles to be separated from the intermediate compartments to terminal compartments of the collection system, through the cyclone vacuums.

A further aim of the present invention is a device for electrostatic separation allowing the method according to the invention to be implemented. More specifically, the aim of the present invention is a device for the electrostatic separation of a granular material comprising particles having a diameter ranging between 50 μm and 2 mm, and preferably ranging between 0.125 mm and 2 mm, the device comprising:

a device for charging the particles to be separated;

a separation chamber comprising two coaxial cylindrical electrodes with a vertical axis OZ divided into:

an internal cylindrical electrode with an external diameter $d_{ie}$ and an external cylindrical electrode with an internal diameter $d_{ei}$;

the cylindrical electrodes being connected to high direct voltage generators, one of the electrodes being connected to the positive terminal of said generator and the other one of the electrodes being connected to its negative terminal, so as to be able to generate an electric field E;

means for producing, by suction, in the separation chamber, a descending vertical air flow perpendicular to the direction of the electric field E;

mechanical means for cleaning the surface of the electrodes, the mechanical cleaning means being free to rotate about the vertical axis OZ and the electrodes being fixed, or vice versa (i.e., in other words, the electrodes are free to rotate about the vertical axis OZ, whereas the mechanical cleaning means are fixed);

a device for recovering particles.

Alternatively, the cylindrical electrodes of the separation chamber can connect to high direct voltage generators with positive and negative polarities, with one of the electrodes being connected to one of the polarities of said generators and the other electrode being connected to the other polarity or to ground, so as to be able to generate an electric field E.

The granular material intended to be separated in the device according to the invention is as previously defined.

According to a first embodiment of the electrostatic separation device according to the invention, the charging device advantageously can be a triboelectric charger communicating with the separation chamber via a cone dispenser.

According to a second embodiment of the electrostatic separation device according to the invention, the charging device advantageously can be a corona effect and electrostatic induction charger located in the separation chamber upstream of the electrodes, with the supply of material for said charging device occurring via a cone dispenser.

According to a third embodiment of the electrostatic separation device according to the invention, the charging device advantageously can be an electrostatic induction charger located in the separation chamber upstream of the electrodes, with the supply of material for said charging device occurring via a cone dispenser.

By way of mechanical means for cleaning the surface of the electrodes, it is possible to use, in the electrostatic separation device according to the invention, brushes or wipers. Advantageously, the means for producing a descending vertical air flow can be cyclone vacuums, preferably with a controlled flow rate, also allowing said particles to be recovered in the collection system.

Advantageously, the device for recovering particles can be a product collection system comprising:

two cylindrical intermediate compartments, coaxial with the system of electrodes and connected to the cyclone vacuums;

two terminal compartments, to which the particles are transferred from the intermediate compartments, through said cyclone vacuums.

Advantageously, the electrostatic separation device according to the invention can further comprise, upstream of the charging device, a dosing unit for granular material that is able to control the flow rate.

Further advantages and features of the present invention will become apparent from the following description, which is provided by way of a non-limiting example and with reference to the accompanying figures.

Figure 2A:
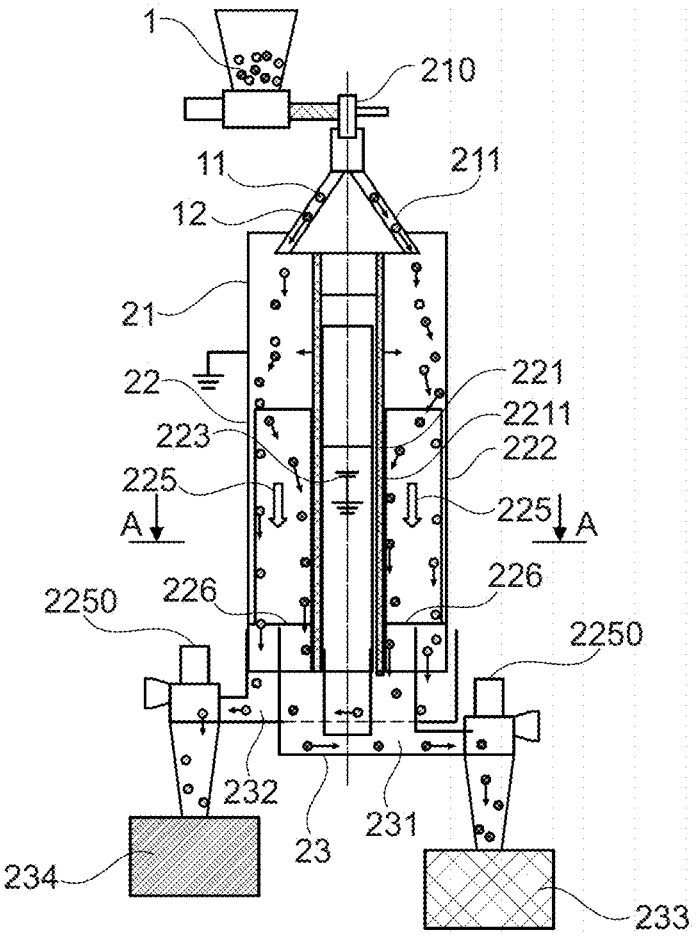
FIG. 2A shows a longitudinal section schematic view of an electrostatic separation device according to the invention in accordance with the second embodiment (with corona effect charger)
Figure 2B:
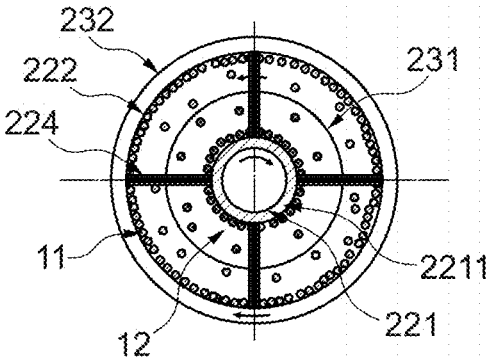
FIG. 2B is a schematic section view along the axis A-A of the device illustrated in FIG. 2A.
Figure 3A:
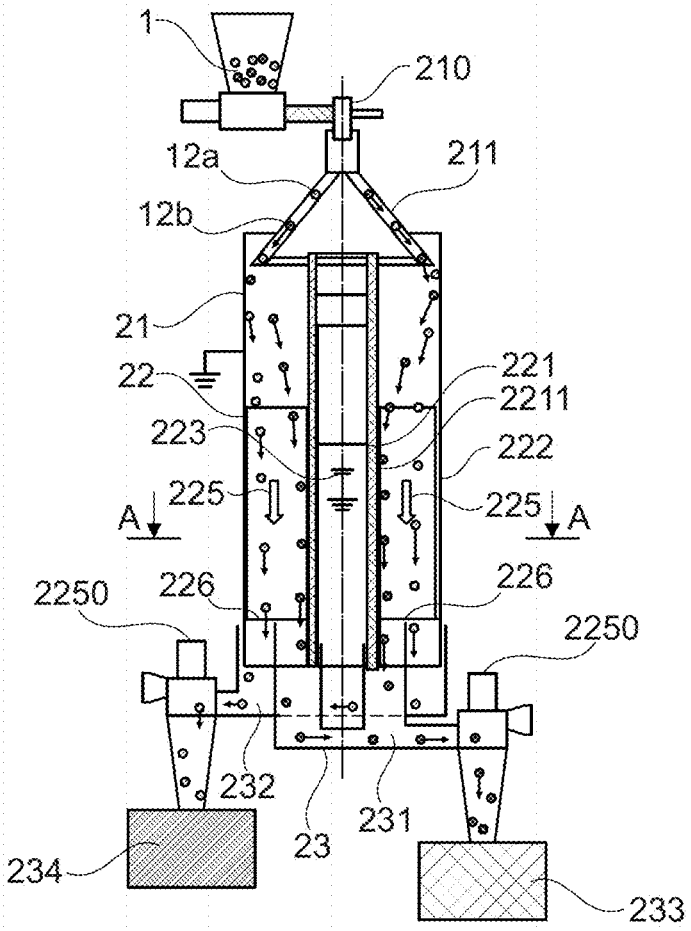
Figure 3B:
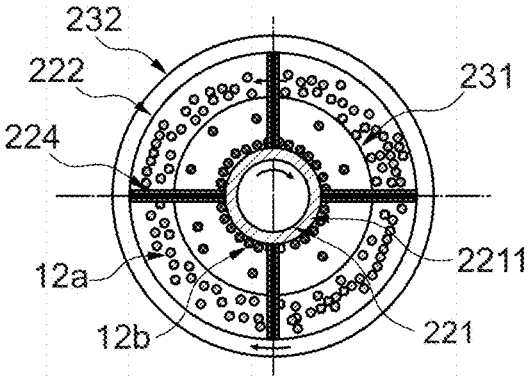
Figure 4:
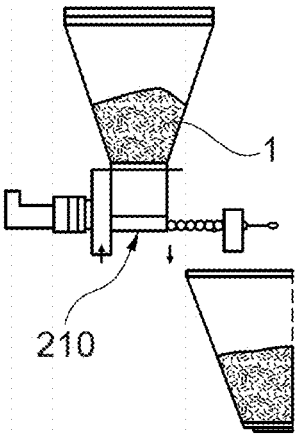
Figure 5:
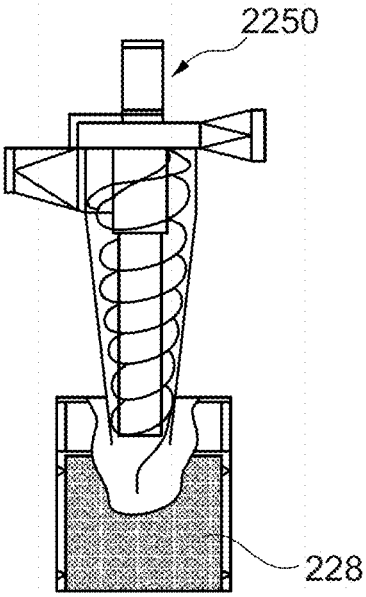
Figure 6:
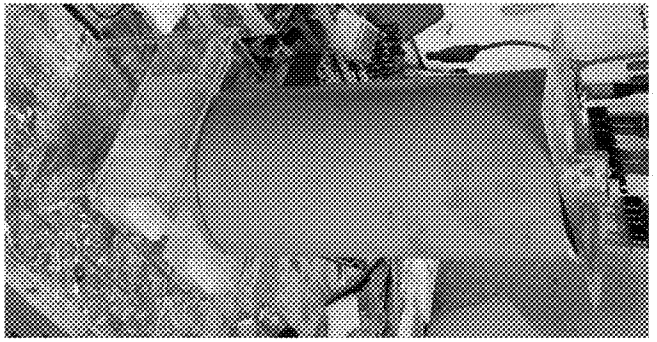
Figure 7A:
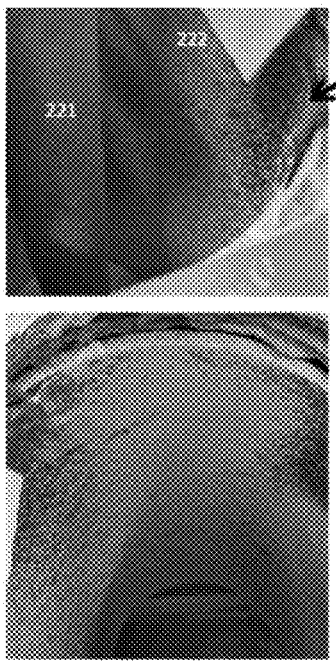
Figure 7B:
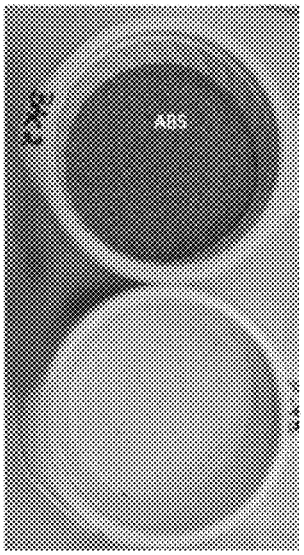
Figure 7C:
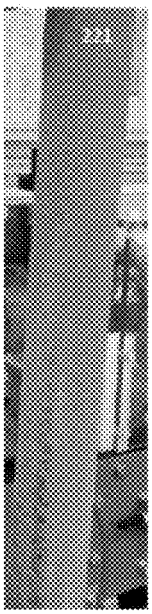
Figure 8:
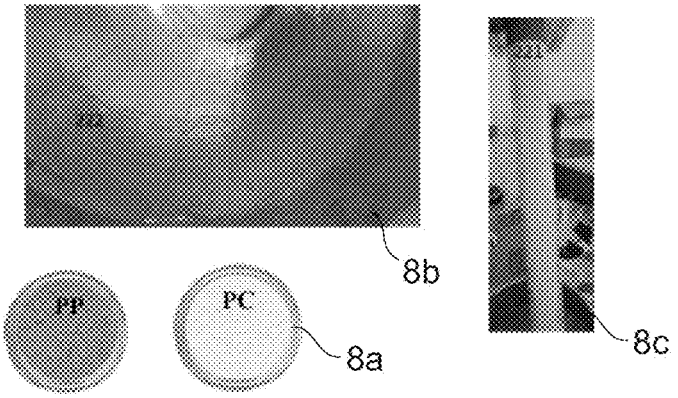
Figure 9:
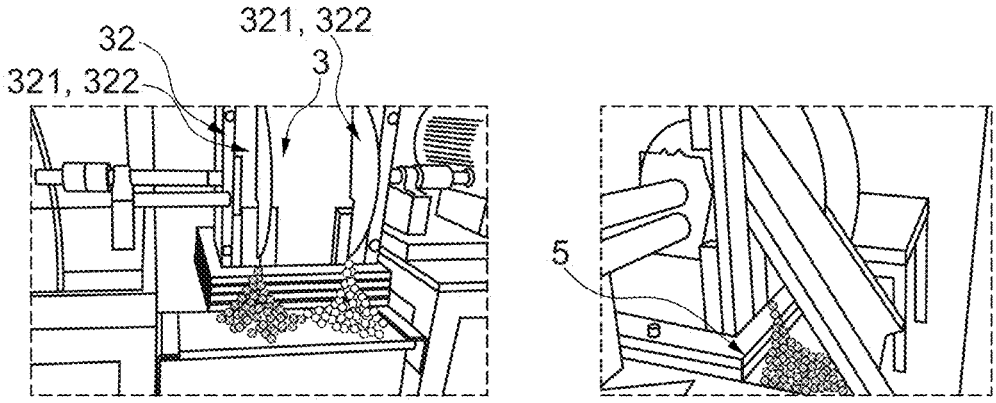
Figure 10:
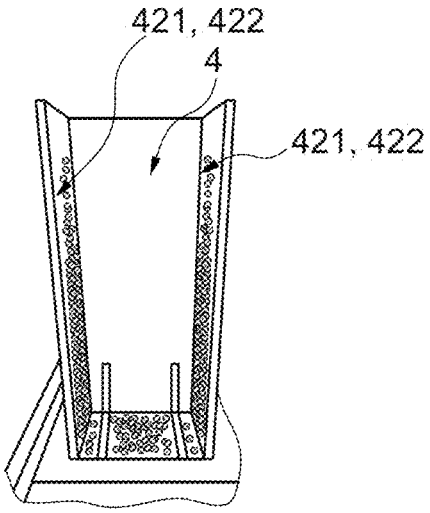
Figure 11:
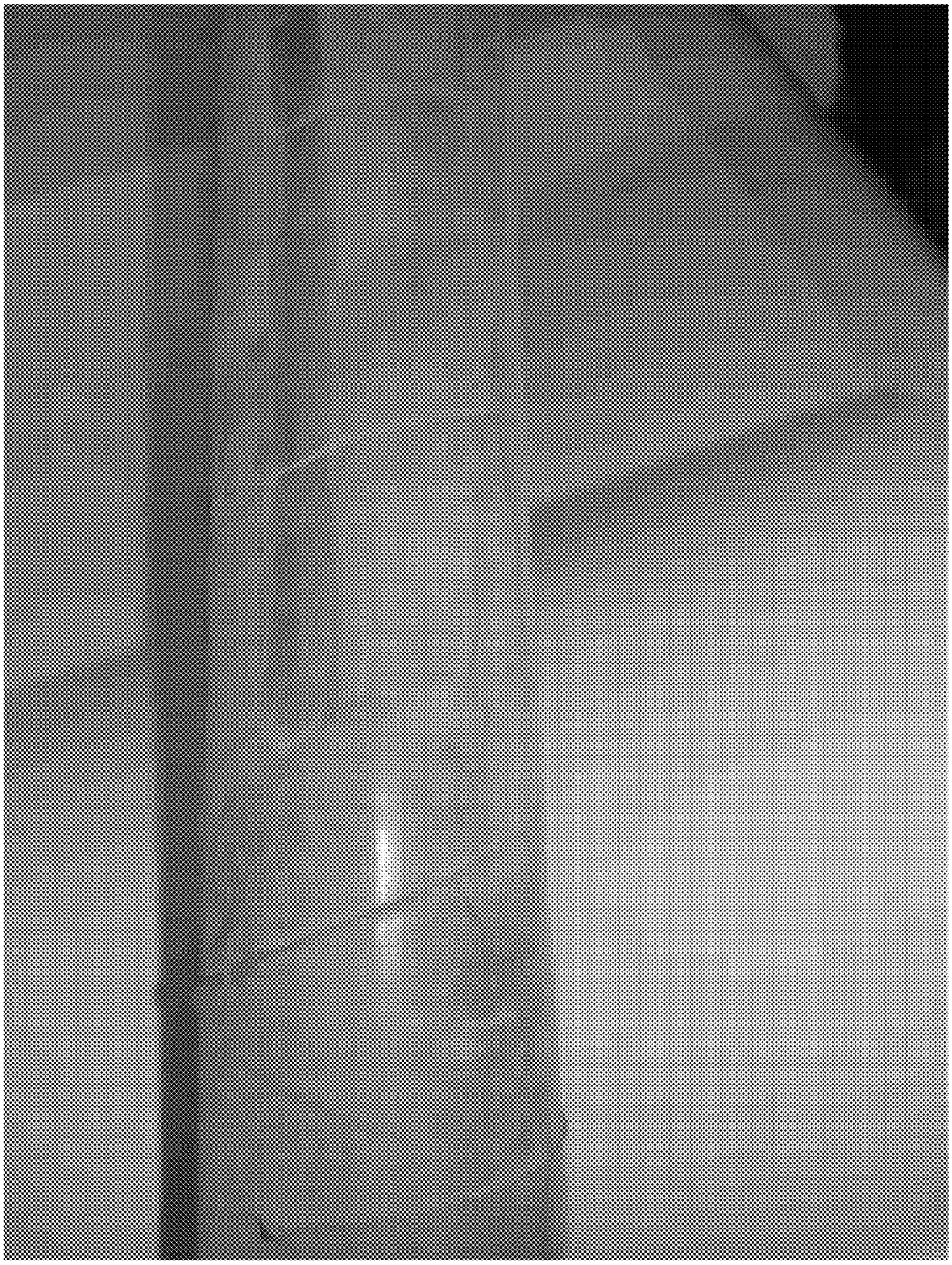
Figure 12:
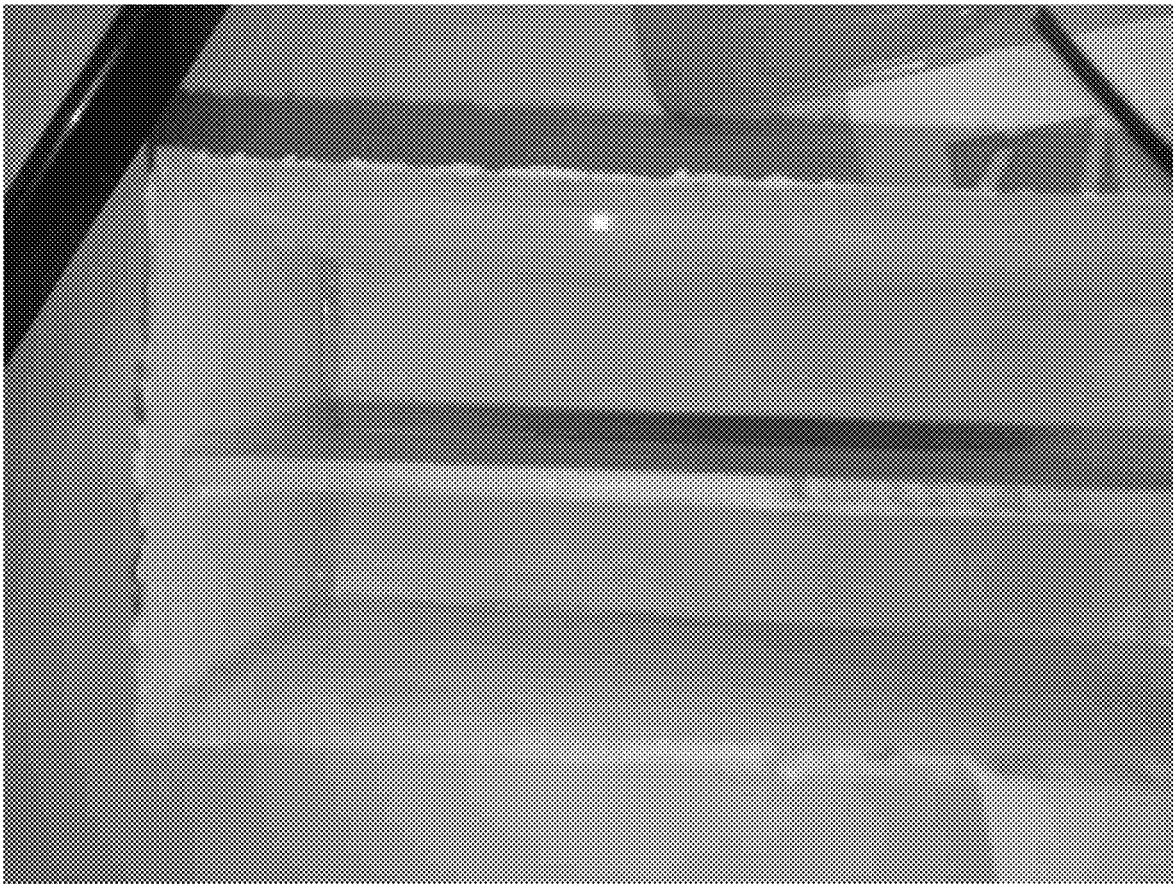
Figure 13:
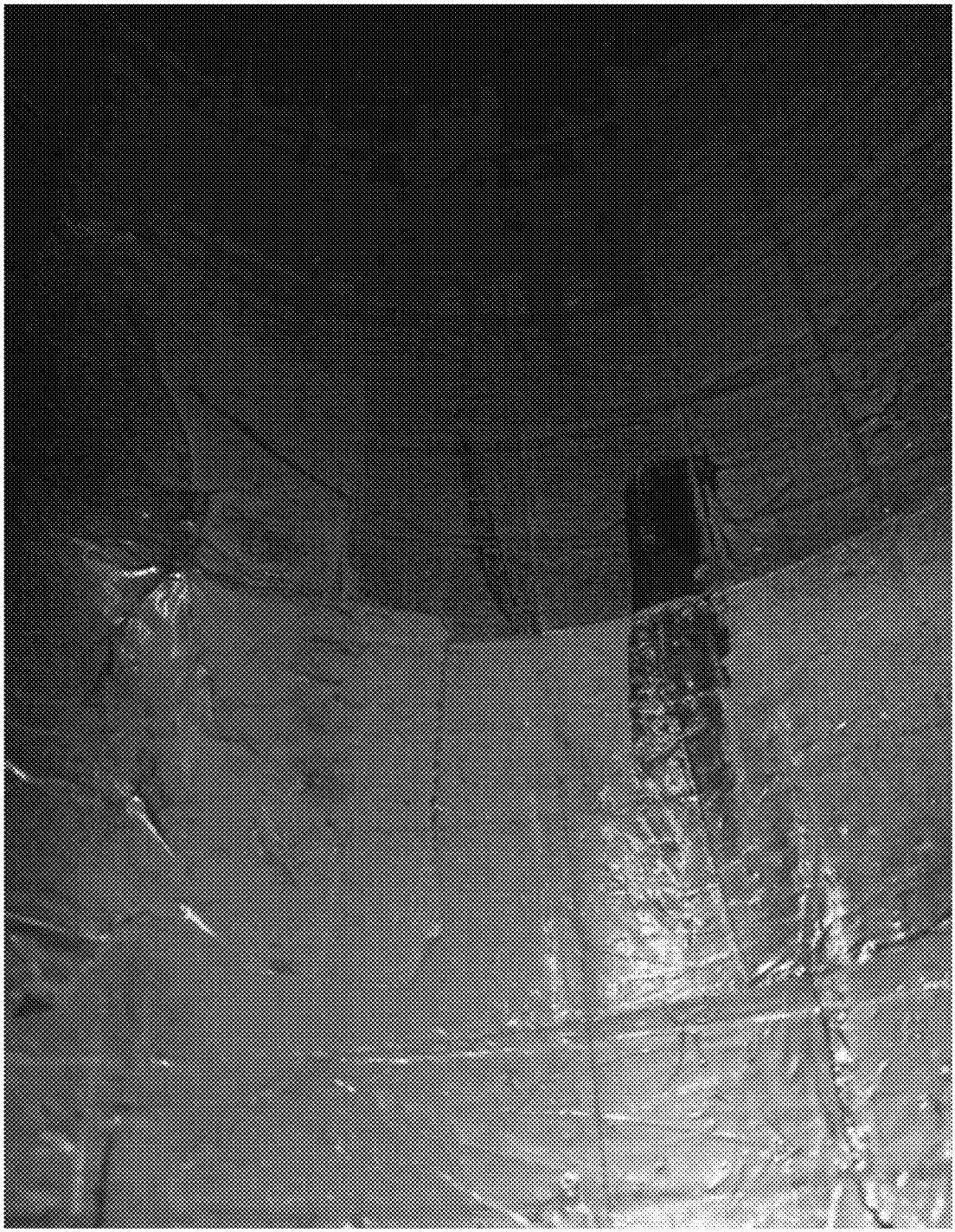

FIG. 3A shows a longitudinal section schematic view of an electrostatic separation device according to the invention in accordance with the third embodiment (with electrostatic induction charging); FIG. 3B is a schematic section view along the axis A-A of the device illustrated in FIG. 3A, FIG. 4 shows a schematic section view of a screw dosing unit for controlling the flow rate of granular material in the charging device;

FIG. 5 shows a schematic section view of a cyclone collection device comprising a cyclone vacuum and a compartment for collecting the particles;

FIG. 6 is a photograph showing a basic prototype of the separator according to the invention (without a system for cleaning the electrodes or a suction system, with fixed electrodes), which has been implemented in example 1 for testing the principle of electrostatic separation implemented in the method according to the invention;

FIG. 7 includes three photographs showing the result of the electrostatic separation of a mixture of particles comprising 50% ABS (acrylonitrile-butadiene-styrene) particles and 50% PC (polycarbonate) particles, with this separation being performed with the prototype of FIG. 6: FIG. 7*b* shows the initial ABS and PP particles (before mixing, then separation); FIG. 7*a* shows the particles recovered on the external electrode 222; and FIG. 7*c* shows the recovered particles on the internal electrode 221 (see example 1);

FIG. 8 also includes three photographs showing the result of the electrostatic separation of a mixture of particles comprising 50% PP (polypropylene) particles and 50% PC (polycarbonate) particles with a diameter of 125 μm, with this separation being performed with the prototype of FIG. 6: FIG. 8*a* shows the initial PP and PC particles (before mixing, then separation); FIG. 8*b* shows the particles recovered on the external electrode 222; and FIG. 8*c* shows the particles recovered on the internal electrode 221 (see example 2);

FIG. 9 includes a photograph showing a tribo-aero-electrostatic electrode disc separator 3 known from the prior art (left-hand photograph) and the results of the separation (right-hand photograph) of a mixture of particles comprising 50% PP particles and 50% PC particles (see comparative example 1);

FIG. 10 comprises a photograph showing a free-fall separator 4 known from the prior art and the results of the separation of a mixture of particles comprising 50% ABS particles and 50% PC particles (see comparative example 2);

FIGS. 11, 12 and 13 show photos of the separation of a mixture of 50 μm diameter copper and aluminum particles composed of 1.4 g of each material;

FIG. 11 is a photograph showing grey aluminum particles collected on the internal cylindrical electrode of the device illustrated in FIGS. 2A and 2B (with corona charger) (see example 3);

FIG. 12 is a photograph showing a copper concentrate (i.e. having a copper content of more than 80%), containing approximately 0.25 g of aluminum and approximately 0.95 g of copper, with this concentrate being collected in the tanks located at the lower end of the system of electrodes of the device illustrated in FIGS. 2A and 2B (with corona charger) (see example 3);

FIG. 13 is a photograph showing a mixed product (i.e. having a copper content that is less than 80%) comprising approximately 25% aluminum and 75% copper, said mixed product being collected on the external electrode of the device illustrated in FIGS. 2A and 2B (with corona charger) (see example 3).

FIGS. 1 to 5 are described in further detail with respect to embodiments of the separation device according to the invention that illustrate the invention, without limiting the scope. In these figures, the identical elements are shown using identical reference numbers.

FIGS. 6 to 13 are described in further detail with reference to the following examples, implementing the separators illustrated in FIGS. 6, 9 and 10.

Figure 1A:
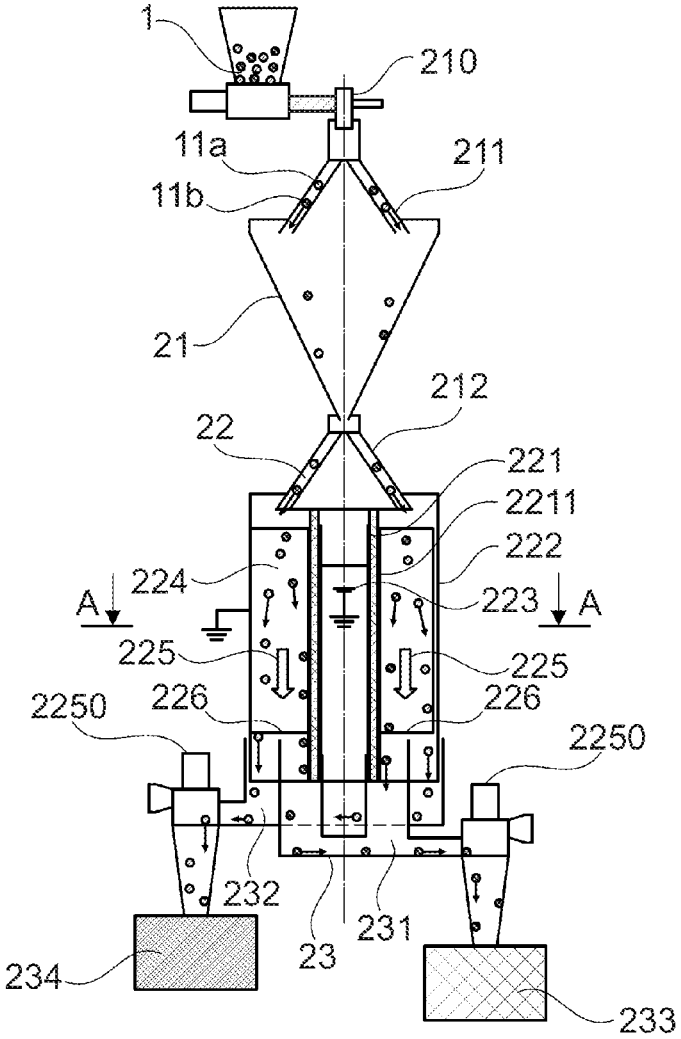
FIG. 1A shows a longitudinal section schematic view of an electrostatic separation device according to the invention in accordance with the first embodiment (with triboelectric charger)
Figure 1B:
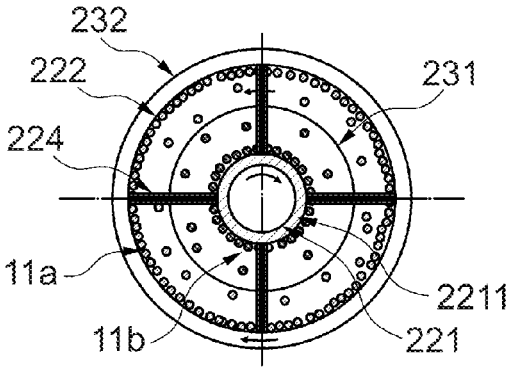
FIG. 1B is a schematic section view along the axis A-A of the device illustrated in FIG. 1A.

With reference to FIGS. 1, 2 and 3, a device for the electrostatic separation of a granular material 1 according to the invention comprises:

- a device 21 for charging the particles 11 and 12 to be separated from the granular material 1;
- a separation chamber 22 comprising two coaxial cylindrical electrodes 221, 222 with a vertical axis OZ;
- suction means 2250 of the cyclone type (the details of which are shown in FIG. 4 only), which create a descending vertical air flow 225 in the separation chamber 22;
- mechanical means 226 for cleaning the surface of the electrodes 221, 222 (for example, brushes or wipers), said mechanical cleaning means 226 being free to rotate about the axis OZ and the electrodes 221, 222 being fixed, or vice versa;
- a collection system 23 comprising two of the intermediate compartments 231 and 232, which are cylindrical and coaxial to the cylindrical electrodes 221, 222, and two final compartments 233 and 234, for respectively recovering the particles 11 and 12 to be separated.

In the three embodiments illustrated in FIGS. 1, 2 and 3, the cyclone vacuums 2250 also allow the particles 11 and 12 collected in the intermediate compartments 231 and 232 to be transferred to the final compartments 233 and 234.

The system of coaxial cylindrical electrodes 221, 222 with a vertical axis OZ is divided as follows:

- an internal cylindrical electrode 221 with an external diameter $d_{ie}$; and
- an external cylindrical electrode 222 with an internal diameter $d_{ei}$.

The cylindrical electrodes 221, 222 are connected to high direct voltage generators with positive and negative polarities, with one being connected to one of the polarities of said generators and the other one being connected to the other polarity or to ground, so as to be able to generate an electric field E, which is perpendicular to the descending vertical air flow 225 generated by the cyclone vacuums 2250.

FIG. 1 more specifically shows a first embodiment of the electrostatic separation device according to the invention, in which the charging device 21 is a triboelectric charger 21 (for example, of the vibration, fluidized bed or rotary cylinder type) communicating with the separation chamber 22 via a cone dispenser 212. The separation device of FIG. 1 further comprises, upstream of the triboelectric charger 21, a screw dosing unit 210 for controlling the flow rate of granular material 1 in the charger 21.

The granular material 1 is separated as follows using the separation device of FIG. 1, which is configured to separate a granular mixture of non-conductive particles 11*a* and 11*b* of different natures:

- two coaxial metal cylinders 221, 222 (electrodes), which are fixed or driven in the same direction by electric motors (not shown in FIGS. 1 to 4), at moderate speeds of several tens of revolutions per minute;
- the two cylinders 221, 222 are connected to opposite polarity high-voltage generators (or with one of the electrodes connected to ground 223), thus creating an intense electric field E zone;
- the granular mixture 1 to be separated is firstly fed, by the screw dosing unit 210, into the triboelectric charger 21;
- the charged particles 11*a* and 11*b* are subsequently continuously transferred by an air flow and by the force of gravity in the electric field created between the two coaxial cylindrical electrodes. Since they are attracted by the opposite polarity electrodes, the particles 11*a* and 11*b* that are respectively positively and negatively charged adhere to the surface thereof;
- a cone dispenser 212 is connected to the output of the triboelectric charger 21 and is used to continuously introduce the charged particles 11*a* and 11*b* into the space between the two cylindrical electrodes 221, 222, where an electric field prevails. This transfer is facilitated by a descending air flow generated by the cyclone vacuum 2250 and the force of gravity;
- since they are attracted by the opposite polarity electrodes 221, 222, the particles 11*a* and 11*b* adhere to the surface thereof;
- fixed cleaning means 226 subsequently allow them to be detached from the electrodes 221, 222 and to be recovered in two compartments 231 and 232 of the product collection system 23. If the electrodes 221, 222 are rotary electrodes, in this case the cleaning means are fixed.

Thus, the cleaning of the electrodes 221, 222 and the collection of the particles 11*a* and 11*b* once they are separated are performed continuously, in a sealed installation, allowing granular mixtures 1 to be treated of millimetric and sub-millimetric size.

FIG. 2 more specifically shows a second embodiment of the electrostatic separation device according to the invention, in which the charging device 21 is a corona effect charger located in the separation chamber 22 upstream of the electrodes 221, 222. The separation device of FIG. 2 further comprises, upstream of the separation chamber 22, a screw dosing unit 210 and a cone dispenser 211 communicating with the corona effect charger 21, with the screw dosing unit 210 allowing the flow rate of granular material 1 in the charger 21 to be controlled.

The granular material 1 is separated as follows using the separation device of FIG. 2, which is configured to separate a granular mixture of non-conductive particles 11 and of conductive particles 12:

- two coaxial metal cylinders 221, 222 (electrodes), which are fixed or driven in the same direction by electric motors (not shown in FIGS. 1 to 4), at moderate speeds of several tens of revolutions per minute;
- the two cylinders 221, 222 are connected to opposite polarity high-voltage generators (or with one of the electrodes connected to ground), thus creating an intense electric field E zone;
- the granular mixture 1 to be separated is firstly fed, by the screw dosing unit 210, then via the cone dispenser 212, into the separation chamber 22, in a corona discharge electric field zone, created between a series of metal points raised to a high-voltage and the external cylindrical electrode 222, connected to ground;
- the non-conductive particles 11, charged by the "ion bombardment" generated by the corona discharge, are attracted by the external cylindrical electrode 222, connected to ground, and remain adhered thereto;

the conductive particles 12 initially charge in the same manner but, in contact with the electrode 22 connected to ground, discharge and charge immediately (by electrostatic induction) at an opposite polarity. They are subsequently attracted by the internal cylindrical electrode 221. This is covered with a non-conductive layer 2211, which prevents contact between the particles 12 and the electrode, as well as the discharging and even the changing of polarity of said particles;

as for the device of FIG. 1, one of the cleaning means 226, associated with cyclone vacuums 2250, allows the particles attached to the two electrodes 221, 222 to be collected separately.

FIGS. 3A and 3B more specifically show a third embodiment of the electrostatic separation device according to the invention, in which the charging device 21 is an electrostatic induction charger located in the separation chamber 22 upstream of the electrodes 221, 222. The separation device of FIG. 3 further comprises, upstream of the separation chamber 22, a screw dosing unit 210 and a cone dispenser 211 communicating with the electrostatic induction charger 21, with the screw dosing unit 210 allowing the flow of granular material 1 in the charger 21 to be controlled.

The granular material 1 is separated as follows using the separation device of FIG. 3, which is configured to separate a granular mixture of conductive particles 12:

two coaxial metal cylinders 221, 222 (electrodes), which are fixed or driven in the same direction by electric motors (not shown in FIGS. 1 to 4), at moderate speeds of several tens of revolutions per minute;

the two cylinders 221, 222 are connected to opposite polarity high-voltage generators (or with one of the electrodes connected to ground), thus creating an intense electric field E zone;

the granular mixture 1 to be separated is firstly fed, by the screw dosing unit 210, then via the cone dispenser 212, into the separation chamber 22, in an electrostatic induction zone, created by the electric field E between the internal 221 and external 222 cylindrical electrodes;

the conductive particles 12*a* and 12*b* charge in the electric field E, in contact with the external electrode of the electrostatic induction charger 21. The difference in the superficial electric resistances of the conductive particles 12*a* and 12*b* leads to different charging levels for the particles that are more or less attracted by the cylindrical electrode, thus resulting in the separation thereof;

as for the device of FIG. 1, one of the cleaning means 226, associated with cyclone vacuums 2250, allows the particles attached to the two electrodes 221, 222 to be collected separately.

EXAMPLES

Equipment prototype of the separator according to the invention illustrated in FIG. 6; it is fed by a 50 mm wide oscillating spout that allows a flow rate of 4 g/s. In the event that the supply of material is provided through a dispensing cone with a 500 mm circumference, the flow rate would be 40 g/s=2400 g/min=144 kg/h. For particle sizes ranging from 0.125 mm to 0.25 mm, the flow rate would reduce to less than 38 kg/h. These flow rates clearly need to correspond to the dimensions of the cylindrical electrodes;

tribo-aero-electrostatic electrode disc separator 3 illustrated in FIG. 9;

free-fall separator 4 illustrated in FIG. 10.

Products mixture of particles comprising 50% ABS (acrylonitrile-butadiene-styrene) particles and 50% PC (polycarbonate) particles (see example 1);

mixture of particles comprising 50% PP (polypropylene) particles and 50% 125 μm diameter PC (polycarbonate) particles (see example 2);

mixture of particles comprising 50% copper particles and 50% aluminum particles, with the diameter of the particles being of the order of 50 μm (see example 3).

Example 1

FIG. 7 shows the results of the separation of a mixture composed of 50% ABS and 50% PC particles. The mixture was charged in a vibration system and was subsequently introduced into the separator by an oscillating spout. The purity of this separation is nearly 100%. In the case of a 40% ABS and 60% PC mixture, the ABS product was polluted by PC particles, and the purity dropped to approximately 95%.

Example 2

The results of the separation of a mixture composed of 50% PP and 50% 125 μm PC particles are shown in FIG. 8. The charging and the introduction of the mixture are identical to those described in example 1. The purities of the obtained products are nearly 100%.

Example 3

A feasibility test of the electrostatic separation of the constituent elements of a conductive/conductive mixture was performed with the electrostatic separation device according to the invention, in which the charging device 21 is a corona effect charger (illustrated in FIG. 2A). The tested sample is a sample composed of 1.4 g of copper particles, and of 1.4 g of aluminum particles, with the diameter of the particles being of the order of 50 μm.

The electrodes were powered at a voltage of 17 kV, for a current of 0.006 mA.

More than 70% of the lighter aluminum particles was collected on the internal cylindrical electrode, with a purity of nearly 100% (as illustrated in FIG. 11). The heavier copper particles were recovered in the tanks located at the lower end of the system of electrodes, in a product weighing 1.2 g and also containing up to 20% of aluminum (as illustrated in FIG. 12). The remainder of the particles of the two metals (approximately 0.5 g) was "adhered" onto the surface of the external cylindrical electrode (as illustrated in FIG. 13).

Comparative Example 1

The mixture of 50% PP and of 50% PC (mixture of light grey and dark grey colors) was also separated in a known separator 3 of the prior art: it is a tribo-aero-electrostatic electrode discs 321, 322 separator 3. Charging and separation are performed in the separation chamber 32 of the separator 3. The mixture of particles is charged in a fluidized bed and the charged particles are attracted by the electrode discs 321, 322, which discharges them in their rotational movement. This separator allows separation at a continuous rate with a flow rate of only 10 g/s, yet also with sealing and recovery problems, mainly for the fine particles, at the output of the electrodes 321 and 322. The results of this separation, as well as the sealing and recovery problems 5 are shown in FIG. 9.

Comparative Example 2

FIG. 10 illustrates the results of the separation of the 50% ABS and 50% PC mixture in a known separator 4 of the prior art: it is a free-fall electrostatic separator 4, with two plate electrodes 421, 422. The mixture was charged in a vibration system and was subsequently introduced into the separator 4 by an oscillating spout. The free-fall separator 4 does not enable work at a continuous rate and the separation degrades once the electrodes 421, 422 are covered with particles.

LIST OF REFERENCES

[1] Benabderrahmane, A., Zeghloul, T., Medles, K., Tilmatine, A., Dascalescu, L., "Experimental investigation of a roll-type tribo-electrostatic separator for granular waste plastics," Conf. Rec. IEEE/IAS Annual Meeting, Cincinnati, Ohio, Oct. 1-5, 2017. DOI: 10.1109/IAS.2017.8101696.

[2] Richard, G., Salama, A., Medles, K., Zeghloul, T., Dascalescu, L., "Comparative study of three high-voltage electrode configurations for the electrostatic separation of Aluminum, Copper and PVC from granular WEEE," J. Electrostat, 88 (2017) 29-34. DOI: 10.1016/j.elstat.2016.12.022.

[3] French patent FR3015312 by CIRAD and INRA.

[4] French patent FR3015311 by INRA.

[5] French patent application FR2943561 by APR2 and by the University of Poitiers.

[6] Miloudi, M., Remadnia, M., Dragan, C., Karim, M., Tilmatine, A., Dascalescu. L., "Experimental study of the optimum operating conditions of a pilot-scale tribo-aero-electrostatic separator of mixed granular solids." IEEE Trans. Ind. Appl., 49 (2013) 699-706.

[7] Tilmatine, A., Benabboun, A., Brahmi, Y., Bendaoud, A.; Miloudi, M., Dascalescu, L., "Experimental investigation of a new triboelectrostatic separation process for mixed fine granular plastics." IEEE Trans. Ind. Appl., 50 (2014) 4245-4250.

[8] Zeghloul, T., Mekhalef Benhafssa, A., Richard, G., Medles, K., Dascalescu, L., "Effect of particle size on the tribo-aero-electrostatic separation of plastics." J. Electrostat, 88 (2017) 24-28.

[9] Mekhalef Benhafssa, A., Medles, K., Bouhhoulda, M. F., Tilmatine, A., Messal, S., Dascalescu, L., "Study of a tribo-aero-electrostatic separator for mixtures of micronized insulating materials," IEEE Trans. Ind. Appl., 51 (2015) 4166-4172.

[10] Brahami, Y., Tilmatine, A., Bendimerad, S. E., Miloudi, M., Zelmat, M. E.-M., Dascalescu, L., "Tribo-aero-electrostatic separation of micronized mixtures of insulating materials using "back-and-forth" moving vertical electrodes." IEEE Trans. DEI, 23 (2016) 699-704.

The invention claimed is:

1. A method for the electrostatic separation of a granular material comprising particles having an equivalent diameter ranging between 50 μm and 2 mm, said method comprising the following steps:

A. introducing said granular material into a charging device at a constant flow rate allowing said particles to be charged as a function of their nature, then charging said particles;

B. generating an electric field E between two coaxial cylindrical electrodes with a vertical axis (OZ) disposed in a separation chamber, the intensity of E varying between 1 kV/cm and 10 kV/cm;

the two cylindrical electrodes being divided into an internal cylindrical electrode with an external axis diameter $d_{ie}$ and an external cylindrical electrode with an internal diameter $d_{ei}$;

said cylindrical electrodes being connected to a high direct voltage generator, one of said electrodes being connected to the positive terminal of said generator and the other one of said electrodes being connected to its negative terminal or to ground;

so as to create an electric field zone in the form of a cylindrical layer with a thickness e that complies with the formula:

$$e=(d_{ei}-d_{ie})/2; \quad (1)$$

C. generating, by suction, in said electric field zone, a descending vertical air flow perpendicular to the direction of the electric field E and for which the effect, combined with the effect of gravity, allows said particles, once charged, to be continuously transferred to said electric field zone;

D. moving said charged particles when they are located in said electric field zone toward the opposite polarity electrodes in order to adhere thereto;

E. continuously detaching, using mechanical means for cleaning the surface of the electrodes, said particles adhering to the surface of said electrodes, said mechanical cleaning means being free to rotate about the vertical central axis (OZ) of the electrodes and said electrodes being fixed, or vice versa;

F. continuously discharging said detached particles under the combined action of gravity and of said vertical air flow; then G. recovering said particles.

2. The method as claimed in claim 1, wherein said particles have an equivalent diameter ranging between 0.125 mm and 2 mm.

3. The method as claimed in claim 1 or 2, wherein:

said granular material comprises only non-conductive particles, distributed in two different categories;

the charging of said particles is performed by the triboelectric effect in a triboelectric charger communicating with said separation chamber via a cone dispenser.

4. The method as claimed in claim 1, wherein:

said granular material comprises a mixture of non-conductive particles and of conductive particles;

the charging of said particles is performed in said separation chamber by the corona effect in a corona effect charger located upstream of said electrodes.

5. The method as claimed in claim 1, wherein:

said granular material comprises a mixture of conductive particles;

the charging of said particles is performed in said separation chamber by electrostatic induction generated by the electric field along said electrodes.

6. The method as claimed in claim 1, wherein the intensity of the intense electric field E ranges between 4 kV/cm and 5 kV/cm.

7. The method as claimed in claim 1, wherein the charged materials are introduced into the electric field zone in the form of a cylindrical layer with a thickness that ranges between 1 mm and 5 mm, according to the size of the particles.

8. The method as claimed in claim 1, wherein the diameter of said particles (11, 11*a*, 11*b*, 12, 12*a*, 12*b*) to be separated ranges between 0.125 mm and 2 mm.

9. The method as claimed in claim 1, wherein the step F) of recovering said particles is performed in a collection system, with said particles being recovered in intermediate compartments of the collection system, said intermediate compartments being cylindrical, coaxial with said electrodes and each being connected to a cyclone vacuum.

10. The method as claimed in claim 8, further comprising a step of transferring said particles from the intermediate compartments to terminal compartments of the collection system, through said cyclone vacuums.

11. A device for the electrostatic separation of a granular material comprising particles having a diameter ranging between 125 μm and 2 mm, said device comprising:

a device for charging said particles to be separated;

a separation chamber comprising two coaxial cylindrical electrodes with a vertical axis (OZ) divided into:

an internal cylindrical electrode with an external diameter $d_{ie}$ and an external cylindrical electrode with an internal diameter $d_{ei}$;

said cylindrical electrodes being connected to a high direct voltage generator, one of said electrodes being connected to the positive terminal of said generator and the other one of said electrodes being connected to its negative terminal, so as to be able to generate an electric field E;

means for producing, by suction, in said separation chamber, a descending vertical air flow perpendicular to the direction of the electric field E;

mechanical means for cleaning the surface of the electrodes, said mechanical cleaning means being free to rotate about the axis (OZ) and said electrodes being fixed, or vice versa; and a device for recovering said particles.

12. The device as claimed in claim 11, wherein the charging device is a triboelectric charger communicating with said separation chamber via a cone dispenser.

13. The device as claimed in claim 11, wherein the charging device is a corona effect charger located in said separation chamber upstream of said electrodes, the supply of material for said charging device occurring through a cone dispenser.

14. The device as claimed in claim 11, wherein said mechanical means for cleaning the surface of the electrodes are brushes or wipers.

15. The device as claimed in claim 11, wherein the means for producing a descending vertical air flow are cyclone vacuums, also allowing said particles to be recovered in the collection system.

16. The device as claimed in claim 15, wherein the device for recovering said particles is a product collection system comprising:

two cylindrical intermediate compartments coaxial with the system of electrodes and connected to the cyclone vacuums;

two terminal compartments, to which said particles are transferred from said intermediate compartments, through said cyclone vacuums.

17. The device as claimed in claim 11, further comprising, upstream of said charging device, a dosing unit for granular material that is able to control the flow rate.

* * * * *